United States Patent [19]

Goldbeck et al.

[11] Patent Number: 4,589,358

[45] Date of Patent: May 20, 1986

[54] AUTOMATIC POCKET OPENING SEWING MACHINE HAVING A CUTTING DEVICE FOR PRODUCING NOTCHING CUTS

[75] Inventors: Heinz Goldbeck, Bielefeld; Horst Plassmeier, Herford; Klaus Möller, Bielefeld, all of Fed. Rep. of Germany

[73] Assignee: Durkoppwerke GmbH, Fed. Rep. of Germany

[21] Appl. No.: 699,027

[22] Filed: Feb. 7, 1985

[30] Foreign Application Priority Data

Feb. 10, 1984 [DE] Fed. Rep. of Germany ..... 3404758

[51] Int. Cl.[4] ..... D05B 3/00

[52] U.S. Cl. ..... 112/68; 112/70

[58] Field of Search ..... 112/68, 65, 70, 67, 112/130, 129

[56] References Cited

U.S. PATENT DOCUMENTS

| | | | |
|---|---|---|---|
| 3,653,345 | 4/1972 | Bianchi | 112/65 |
| 3,814,037 | 6/1974 | Nicolay | 112/68 |
| 3,847,097 | 11/1974 | Dusch et al. | 112/68 |
| 4,075,954 | 2/1978 | Hintzen et al. | 112/68 |
| 4,271,768 | 6/1981 | Goldbeck | 112/68 |
| 4,416,204 | 11/1983 | Kaze | 112/68 |

FOREIGN PATENT DOCUMENTS

| | | | |
|---|---|---|---|
| 3492 | 8/1979 | European Pat. Off. | 112/68 |

*Primary Examiner*—H. Hampton Hunter

*Attorney, Agent, or Firm*—Ostrolenk, Faber, Gerb & Soffen

[57] ABSTRACT

A pocket opening sewing machine including a cutting device for producing two notching cuts at the ends of a pocket opening. The sewing machine has sewing needles and a belt driven clamping device for clamping to the sewn parts for advancing them in an advancing direction. The cutting device includes two knives spaced apart. The knife that is further from the sewing needles is movable toward the stationary knife that is closer to the needles. For adjusting the spacing between the knives, the movable knife is temporarily clamped to a moving belt which moves it toward the stationary knife. An adjustably positionable stop defines the furthest limit of spacing between the stationary and movable knives and a spring drives the movable knife against the stop. The clamping of the movable knife to the belt is initiated by a sensor which senses the passage of a sewn part and which operates a microcomputer with pocket length information stored in it to move the movable knife when required over the distance required. Alternately, if the movable knife moves at a speed faster than the advancing speed of the sewn parts, adjustment of the movable knife stop can be dispensed with.

14 Claims, 2 Drawing Figures

AUTOMATIC POCKET OPENING SEWING MACHINE HAVING A CUTTING DEVICE FOR PRODUCING NOTCHING CUTS

BACKGROUND OF THE INVENTION

The present invention relates to an automatic pocket opening sewing machine having a cutting device for notching cuts into the pocket.

A device for forming notching cuts at the ends of pocket openings in sewn material parts is known from Federal Republic of Germany Pat. No. 23 22 696. It includes two wedge shaped knives, each of which is movable to make a respective notching cut in the material. The wedge knife which is located closest to the place of sewing, i.e. to the sewing needles, is in drive connection with a lever transmission which moves that displaceable knife over the same distance as the advance of the sewn material, while the other wedge knife is stationary. The sewn material parts which are to be brought into the cutting position must move over a relatively large path in order that the starting point of the pocket opening seam then coincide with the stationary wedge knife which is arranged furthest away from the place of sewing. This known device has the disadvantage that the path to be moved over until the cutting position of the sewn material parts is reached is large enough that it increases the unproductive machine time. As a result, rational and hence profitable production of small size pocket openings cannot be achieved because the sewn material parts must travel over too long a path before arriving at the cutting position, where the notching cuts are made. Travel of those parts over a shorter distance would be preferred.

SUMMARY OF THE INVENTION

The invention has as its object providing an automatic pocket opening sewing machine which has a cutting device which permits rational and profitable operation even for the production of small pocket openings.

The automatic pocket opening sewing machine having a cutting device for producing two notches at the ends of the pocket opening according to the invention includes in combination a sewing machine and a cutting device. The sewing machine comprises a sewing needle, and preferably two needles, and comprises means for operating the needle. It also comprises means for clamping to the sewn parts and then for advancing them past the sewing needle and to the cutting device.

The cutting device comprises two knives which are arranged in sequence along the advancing direction of the sewn parts and downstream of the needle or needles. Each knife is independently operable for moving toward the sewn part for making a notching cut. The knife that is nearer to the sewing needle is stationary along the direction of advance of the sewn parts. The knife that is further from the sewing needle is movable toward the stationary knife for adjusting the spacing between the knives so as to make the cuts in the sewn parts desirably spaced apart. In order to obtain the desired spacing by moving the movable knife, there are means for temporarily engaging the movable knife for moving it counter to the direction of advance of the sewn parts and toward the stationary knife.

The automatic pocket opening sewing machine of the invention permits, after the sewing of the pocket opening seam, bringing the end of that seam into coincidence with the stationary wedge knife which is located closest to the place of sewing. For this purpose, the sewn material parts need be displaced only over a minimum path until each reaches the cutting position. As a result, unproductive machine time is reduced to a minimum.

The above-noted means for engaging and for moving the movable knife toward the stationary knife comprises a continuously operating knife moving means, and more particularly comprises an endless belt, which may be a toothed belt. The knife moving means moves past the location of the movable knife. There are means at the movable knife for clamping the movable knife temporarily to that moving means or belt so that the movable knife is moved toward the stationary knife. The movable knife includes a support pedestal on which the knife is supported. The clamping means is a hydraulically operated or electromagnetically operated clamping means on the pedestal which clamps to the moving means belt.

There is a stop for the movable knife which stop is place for defining the furthest point of the spacing of the movable knife from the stationary knife. Biasing means in the form of a spring normally drives the movable knife toward the stop. The means for moving the movable knife moves the movable knife against the bias of the spring and toward the stationary knife.

In order to control the operation of the movable knife and its movement toward the stationary knife, a sensor is provided, preferably upstream of the sewing needle, for sensing the passage therepast of a sewn part which is eventually to be cut. Control means, in the form for example, of a microcomputer, is programmed with information about the respective length of the particular seam of the pocket opening to be cut. That control means receives the sensed information about the passage of the sewn part and then operates the clamping means for causing the movable knife to move the preselected distance toward the stationary knife.

In a further embodiment of the cutting device of an automatic pocket opening sewing machine, the sewing of small pocket openings whose seam length is less than a permitted limit value is made possible by automatic displacement of the stop which limits the end position of the movable wedge knife. The stop is displaced by a stop displacing means, which may, for example, be in the form of a hydraulic cylinder. There are control means, which may be the same microcomputer described above, which operate the stop displacing means when the length of the seam of the pocket opening is below that preset limit value.

Yet, a further embodiment of the cutting device permits dispensing with that automatic displacement of the aforementioned stop, when sewing small pocket openings. In this case, the means for moving the movable knife in a direction counter to the direction of advance of the sewn parts moves the movable knife at a faster speed than the speed of the means for advancing the sewn parts past the sewing needle. The movable knife will have been moved to the needed location close to the stationary knife before the cutting operation by the two knives must begin.

BRIEF DESCRIPTION OF THE DRAWINGS

One embodiment of the invention is described with reference to FIGS. 1 and 2, in which.

DESCRIPTION OF THE PREFERRED EMBODIMENT

Figure 1:
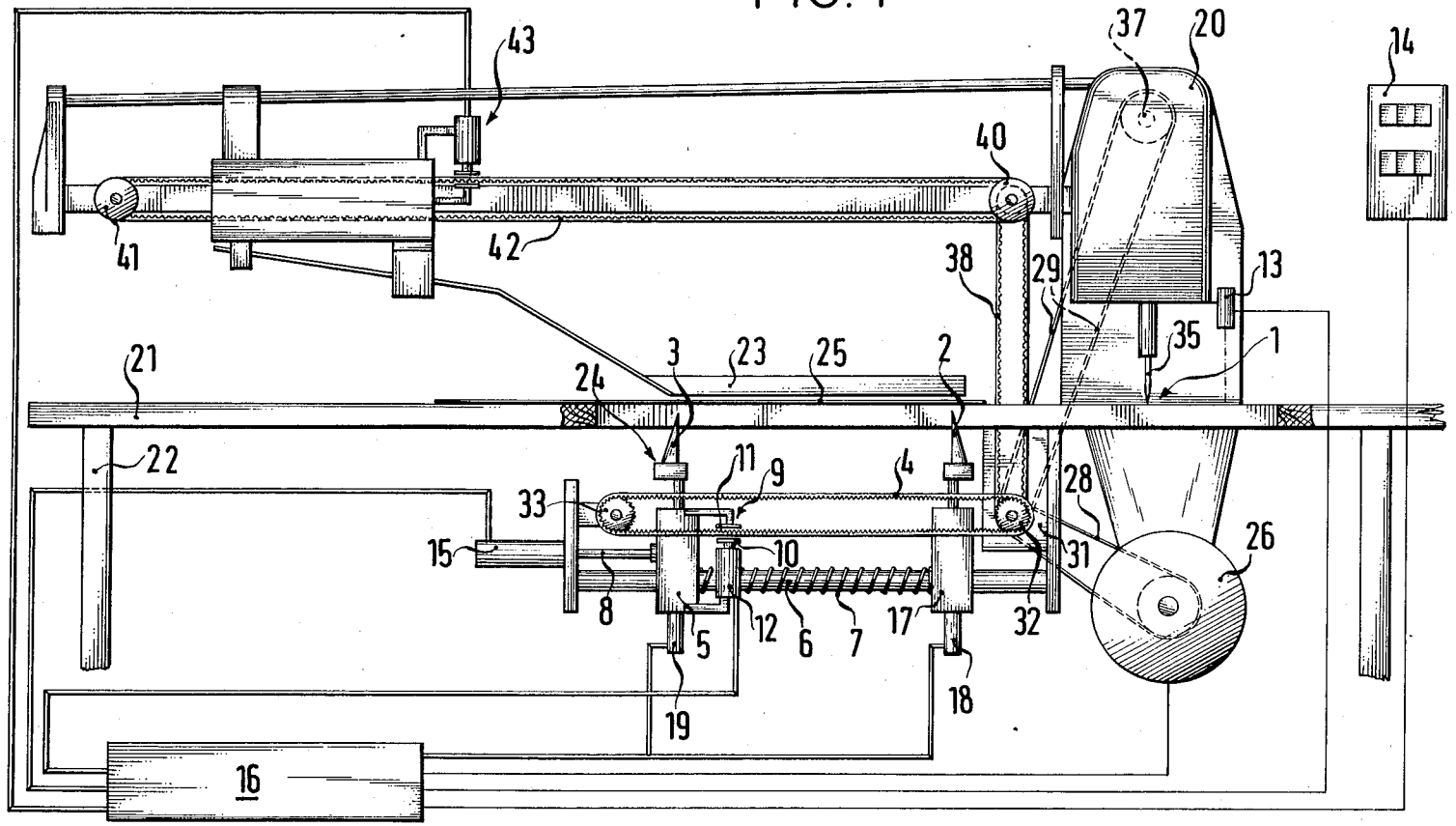
FIG. 1 is a front view of the automatic pocket opening sewing machine of the invention.

The automatic pocket opening sewing machine in which the invention is incorporated is a two-needle sewing machine 20 of traditional type mounted on a frame 22. It has a vertically moving cutting knife arranged between the sewing needles 35. There is a known horizontally displaceable sewn material clamp 23. The sewn material clamp 23 displaces the sewn material parts 25 from an insertion position located in front or upstream of the sewing area 1 at the needles into a cutting position located behind or downsteam of the sewing area 1.

There is also a cutting device 24 which is arranged below the sewn material resting surface 21 and thus below a surface of the sewn parts. The cutting device 24 includes a wedge knife 2 which is mounted on a stationary support pedestal 17 and which is vertically displaceable in height when a respective cylinder 18 has been acted on by pressure fluid. The device 24 also includes a wedge knife 3, which is mounted on a horizontally displaceable support pedestal 5 and which is also vertically displaceble in height when a respective cylinder 19 has been acted on by pressure fluid. The vertical displacement of the wedge knives 2, 3, is usually simultaneous.

The support pedestal 5 is mounted on two horizontal bars 6 which are fixed fast to the frame. Ordinary ball-bearing bushings enable substantially frictionfree displaceability of the pedestal along the bars 6. The furthest position of the support pedestal 5 from the sewing area 1 is defined by an adjustable stop 8 against which the support pedestal 5 is pressed by the action of two compression springs 7 around the shafts 6. Displacement of the stop 8 is caused by a cylinder 15 which can be actuated by pressure fluid or which may be actuated by an electromagnet. When the piston rod in cylinder 15 is acted on by the pressure fluid, or when the armature of the electromagnet carries out a stroke, this moves the support pedestal 5 into a defined position that is displaced toward the sewing area 1, and the movement is against the biasing action of the springs 7.

On the frame 22, below the sewn material resting surface 21, there is a known positioning drive 26. Through suitable belt and pulley means, the drive 26 drives the sewing machine 20, the sewn material clamp 23 and the support pedestal 5 which carries the wedge knife 3. For this purpose, the positioning drive 26, through a V-belt 28, drives an intermediate shaft 27 that is mounted below the sewn material resting place 21. From the shaft 27, an arm shaft 37 of the sewing machine 20 is driven via a clutch 30 and another V-belt 29. Beyond belt 29, the intermediate shaft 27 extends into a stepdown transmission 31. A pulley 44 is firmly attached to an output shaft 34 of the step-down transmission 31. A toothed belt 38 drivingly connects pulley 44 on shaft 34 with a pulley 45 that is located on and drives a shaft 39 which is supported fixed in place on the frame. The pulleys 45 and 40 are firmly attached to the shaft 39. There is also firmly attached to the shaft 39 a known pulse transmitter 47 which provides a microcomputer control 16 with the data necessary for the displacement paths of the sewn material clamp 23 and for the automatic temporary clamping of a clamp 9 onto a belt 4.

Another pulley 41 is carried by the pin 46 which is mounted fast on the frame. Around the pulleys 40, 41 there is wrapped a sewn material displacement means, in the form of a toothed belt 42, which is driven by the positioning drive 26, as described above. A clamp 43, which can be actuated by a pressure fluid or electromagnetically, is firmly connected to the sewn material clamp 23. After the clamp 43 has been acted on by the pressure fluid or after the connection of its electromagnet, the clamp 43 is displaced by the belt 42 and this displaces the sewn material clamp 23 and the clamped sewn material in the advancing direction.

A pulley 32 is rigidly attached to the output shaft 34 of the step-down transmission 31. A pulley 33 is carried on a journal pin 36 which is fastened to the frame space from the shaft 34. A pulling means 4 for displacing the displaceable knife 3, which means 4 is preferably a toothed belt, moves around the pulleys 32 and 33.

A clamp 9 is fastened on the horizontally displaceable support pedestal 5. It comprises a fixed jaw 11 and a displaceable jaw 10. The pulling means 4 moves through the space between the jaws 10, 11 without touching them, and such motion is intermittent. After the cylinder 12 has been acted on by pressure fluid or after its electromagnet has been connected, the pulling means 4 is gripped on both sides by the jaws 10, 11. As a result, the pulling means 4 instantaneously displaces the support pedestal 5 and the supported knife 3 in the direction toward the place of sewing 1 and the stationary knife 2, and against the action of the springs 7. When that position of the support pedestal 5 which corresponds to the size of the pocket entrance to be produced has been reached, the movment of the pulling means 4 is stopped abruptly by the positioning drive 26. The wedge knife 3 thereafter remains in its shifted position.

The microcomputer 16 controls the main functions of the automatic pocket opening sewing machine. The data required for the production of pocket openings of different length are calculated using, inter alia, a sensor arranged at a given distance in front or upstream of the sewing needles 35. The sensor is preferably a light barrier 13, and at least one switch 14 is used for establishing the length of the seam.

The manner of operation of the automatic pocket opening sewing machine makes possible the manufacture of pocket openings both with and without a flap.

Before the manufacture of a pocket opening with a flap, the light barrier 13 upstream of the sewing needles senses the leading and trailing ends of the flap which is to be sewn on. This starts a length measurement, which is to be effected incrementally. On the basis of the measurement, the pocket entrance is sewn. The sewn material clamp 23 displaces the sewn material parts 25 along the path of advance in accordance with the length determined. Upon the sewing of a pocket entrance without a flap, the advance of the sewn material clamp 23 depends upon the seam length that was previously entered in the switch 14.

Figure 2:
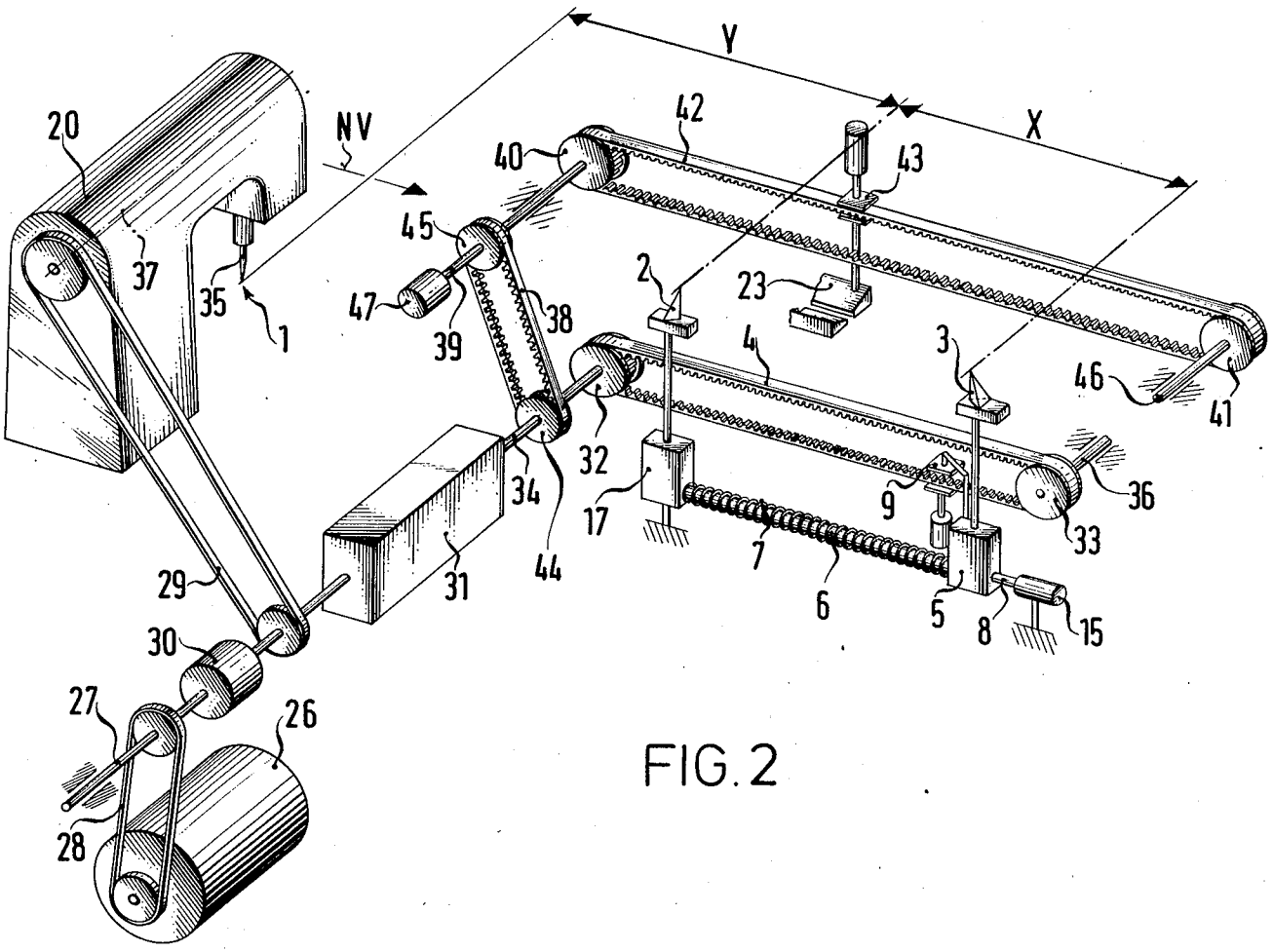
FIG. 2 is an exploded perspective, somewhat schematic view, showing the drive of the sewing machine as well as the drives for the displacement of the sewn material clamp and for the displacement of the horizontally displaceable wedge knife.

After termination of the sewing of the pocket opening seam, the sewn material clamp 23 displaces the sewn material parts 25 over the distance "Y" in FIG. 2, in the direction marked "NV". During this advance of the sewn material clamp 23, and at a defined time which corresponds to the initially determined length of seam of the pocket opening seam, either the cylinder 12 is acted on, preferably by compressed air, or an electromagnet is connected. As a result, the jaws 10, 11 of the clamp 9 close, and the support pedestal 5 is moved, against the action of the spring 7, into a position closer to the sewing area 1. This closer position is characterized by the wedge knives 2 and 3 being precisely at the distance measured or set. In order to exclude errors in distance, the clamp 9 must clamp only when a well-defined speed of the pulling means 4 is present. This means that the closing of the clamp 9 must not take place during acceleration or deceleration of the positioning drive 26. For this purpose, reference is had to an empirically ascertained constant correction factor which is stored in the microcomputer. That factor takes into account a delay between the giving of the signal and the clamping of the jaws 10, 11.

The automatic closing of the clamp 9 will be further explained by the following numerical example. If, for instance, the distance Y in FIG. 2 from the center of the needle to the rear edge of the fixed wedge knife 2 has a value of 130 mm and the maximum distance ×between wedge knife 2 and wedge knife 3 amounts to 190 mm and if, finally, the length of the flap (equal to the size of the pocket opening) is 150 mm, then at the proper moment the wedge knife 3 must be pushed in the direction toward the sewing area 1 by a distance of 190 mm minus 150 mm, or 40 mm, in order that the wedge knives 2 and 3 be at a distance apart of 150 mm prior to the making of the notching cut. The clamp 9 must close precisely at the moment when the sewn material parts 25 present on the path into the cutting position have reached the place at which the end of the pocket opening seam is 40 mm from the wedge knife 2. Both the sewn parts and the movable wedge knife 3 are moving at the same speeds, but in opposite directions. The clamping by clamp 9 at the aforesaid moment causes both the sewn parts and the wedge knife 3 to move 40 mm in their respective directions. This assures that the distance from wedge knife 2 to wedge knife 3 is precisely 150 m when the end of the pocket opening seam coincides with the wedge knife 2.

If, in a subsequent sewn part, for instance, a pocket opening of 60 mm (equal to pocket opening seam) is to be made, the wedge knife 3 must now be displaced in the direction toward the sewing area 1 by a distance of 130 mm (equal to 190 mm minus 60 mm). In order that this displacement be terminated when the end of the pocket opening seam coincides with the wedge knife 2, the clamp 9 would, in this case, have to close at the moment when the end of pocket opening seam is 130 mm in front of the wedge knife 2. At that moment, the sewing of the pocket opening seam has just been completed, i.e. the above-described prerequisite, and closing of the clamp 9 only with a well-defined speed of the pulling means 4, must be satisfied.

In order to produce a smaller pocket opening, for instance one of a length of 60 mm, in a proper manner on the automatic sewing machine of the invention, if a specified limit value for the length of seam of the pocket opening seam is gone below, for instance 65 mm, then the stop 8 is pushed by a predetermined amount, for instance 30 mm, in the direction toward the sewing area 1. This is accomplished by the cylinder 15 which is acted on preferably by compressed air, or an electromagnet is operated. Since this displacement is derived from the initially measured or set length of the seam, it takes place automatically and without any action on the part of the operator. After that displacement of the stop 8, the distance X between the wedge knives 2 and 3 is now 160 mm.

The clamp 9 must now close at the moment when the end of the pocket opening seam is 160 mm minus 60 mm, namely 100 mm, in front of the wedge knife 2. At this moment, the above-mentioned prerequisite for the proper closing of the clamp 9 is again present. This closing of the clamp 9 assures that the distance between the wedge knives 2 and 3 is precisely 60 mm when the end of the pocket opening seam coincides with the wedge knife 2.

For the next following sewn part, if a seam length is again determined which is greated than the above-mentioned limit value of 65 mm, then the cylinder 15 is automatically vented or the electromagnet is disconnected. Due to the relation, i.e. expansion, of the springs 7, the stop 8 again assumes the position furthest away from the sewing area 1.

The above-described automatic displacement of the stop 8 can be dispensed with if the lower pulling means or belt 4 travels with a higher speed than the upper pulling means or belt 42. This can be achieved simply by making the pulleys 32, 33 of larger diameter than the pulleys 40, 41, 44, 45. However, having the pulling means 4 and 42 travel with the same speed provides a manufacturing advantage since because, in that case, the pulleys 32, 33, 44, 45, 40 and 41 have the same dimensions.

After the support pedestal 5 with the wedge knife 3 has assumed the above-described position corresponding to the desired pocket opening, the cylinders 18, 19 are acted on, preferably by compressed air. As a result, the wedge knives 2, 3 move upward and pass through openings present in the sewn material resting surface 21, and this makes the production of the two notch cuts possible in known manner. The cylinders 18, 19 are then vented which returns the wedge knives 2, 3 to their initial positions. When those initial positions have been reached, the cylinder 12 is vented. This frees the support pedestal 5 to return, under the influence of the relaxing springs 7, into its starting position furthest away from the sewing area 1. The sewn material clamp 23 is then lifted slightly off the sewn material resting surface 21. The completely sewn part is removed by a known removal device from the region of the sewn material clamp 23, and the clamp then moves into the insertion position present in front of the sewing area 1. In order to carry out this movement within a shorter period of time, it is advisable to disconnect the sewn material clamp 23 from the pulling means 42 by opening the clamp 43 before the start of the return movement and to temporarilty subject the clamp 23 to the influence of a longstroke cylinder acted on by pressure fluid. In this way, a rapid return is obtained with relatively simple means.

After insertion of sewn material parts which have not yet been provided with pocket openings, the above-described sewing process can be started again.

Above-described cylinders 12 and 15 and clamp 43 are preferably compressed air cylinders that are activated by being charged with compressed air. In alternate embodiments, any one of these might be replaced by electromagnets that perform their respective above-described functions.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. An automatic pocket opening sewing machine having a cutting device for producing two notching cuts at ends of the pocket entrance:

the sewing machine comprising a sewing needle and means for operating the needle for sewing sewn parts passing by the sewing needle; means for first clamping to the sewn parts and for then advancing the sewn parts in an advancing direction past the sewing needle;

the cutting device comprising two knives arranged in sequence downstream of the needle in the advancing direction of the sewn parts, and the knives being disposed above a surface of the sewn parts; a respective operating device for each knife for moving the knife to a cutting position for making a respective gusset cut in a sewn part;

the knife nearer to the sewing needle being stationary along the direction of advance of the sewn parts; the knife further from the sewing needle being movable toward the stationary knife for adjusting the spacing between the movable and stationary knives for making cuts which are desirably spaced apart;

means for temporarily engaging the movable knife and for moving the movable knife counter to the direction of advance of the sewn parts and toward the stationary knife for establishing the desired spacing of the cuts to be made by the stationary and movable knives.

2. The cutting device for a sewing machine of claim 1, wherein the means for engaging and for moving the movable knife comprises a continuously operating knife moving means which moves past the location of the movable knife, and comprises means for clamping the movable knife temporarily to that moving means for moving the movable knife toward the stationary knife a predetermined distance for the desired spacing between the knives.

3. The cutting device for a sewing machine of claim 1, wherein the movable knife is moved to adjust the spacing between the knives to the size of the pocket opening.

4. The cutting device for a sewing machine of claim 2, wherein the means for moving the movable knife comprises a continuously movable belt moving in the direction toward the stationary knife.

5. The cutting device for a sewing machine of claim 2, further comprising a stop for the movable knife for defining a furthest position of spacing of the movable knife from the stationary knife; a spring for normally driving the movable knife to the stop; and the means for moving the movable knife moving the movable knife against the bias of the spring.

6. The cutting device for a sewing machine of claim 5, wherein the movable knife includes a support pedestal on which the movable knife is supported and on which the spring acts; the clamping means comprising a clamp for being operated to clamp the pedestal to the means for moving the movable knife.

7. The cutting device for a sewing machine of claim 6, wherein the movable knife is moved to adjust the spacing between the knives to the size of the pocket opening.

8. The cutting device for a sewing machine of claim 7, wherein the means for moving the movable knife comprises a continuously movable belt moving in the direction toward the stationary knife.

9. The cutting device for a sewing machine of claim 8, wherein the belt is a toothed belt to which the clamp is temporarily clamped.

10. The cutting device for a sewing machine of claim 1, further comprising a sensor for sensing the passage of a sewn part therepast; and control means for receiving the sensed information about the passage of a sewn part, for having programmed into it information about the length of a seam of a pocket entrance, and also connected to and being for operating the clamping means for causing the movable knife to move a preselected distance toward the stationary knife.

11. The cutting device for a sewing machine of claim 10, wherein the sensor is a light barrier.

12. The cutting device for a sewing machine of claim 5, wherein the stop is displaceable toward the sewing needle; means for so displacing the stop; a control means for operating the stop displacing means when the seam length of the pocket entrance is below a preset limit value, for thereby moving the starting place for the movement of the movable knife by the movable knife moving means.

13. The cutting device for a sewing machine of claim 3, wherein the means for moving the movable knife counter to the direction of advance of the sewn parts moves the movable knife at a faster speed than the speed of the means for advancing the sewn parts past the sewing needle.

14. The cutting device for a sewing machine of claim 2, wherein the means for moving the movable knife counter to the direction of advance of the sewn parts moves the movable knife at a faster speed than the speed of the means for advancing the sewn parts past the sewing needle.

* * * * *